US005101867A

United States Patent [19]

Sainen Tsutomo et al.

[11] Patent Number: 5,101,867

[45] Date of Patent: Apr. 7, 1992

[54] PICKING CONTROL FOR AIR JET LOOM WITH TIMING AND PRESSURE CORRECTION

[75] Inventors: Sainen Tsutomo, Kanazawa; Shigeo Yamada, Komatsu, both of Japan

[73] Assignee: Tsudakoma Kogyo Kabushiki Kaisha, Kanazawa, Japan

[21] Appl. No.: 570,349

[22] Filed: Aug. 21, 1990

[30] Foreign Application Priority Data

Aug. 22, 1989 [JP] Japan ..... 1-215530

[51] Int. Cl.[5] ..... D03D 47/30

[52] U.S. Cl. ..... 139/435.2

[58] Field of Search ..... 139/450, 452, 435.2

[56] References Cited

U.S. PATENT DOCUMENTS

| | | | |
|---|---|---|---|
| 4,732,179 | 3/1988 | Takegawa | 139/452 |
| 4,830,063 | 5/1989 | Takegawa | 139/435.2 |
| 4,932,442 | 6/1990 | Ishido et al. | 139/435.2 |
| 4,967,806 | 11/1990 | Imamura et al. | 139/435.2 D X |

*Primary Examiner*—Andrew M. Falik

*Attorney, Agent, or Firm*—Oblon, Spivak, McClelland, Maier & Neustadt

[57] ABSTRACT

A picking control apparatus for providing stable picking operation in a jet loom. The apparatus comprises an angle correcting section for outputting an angle correction amount of a picking start angle on the basis of an arrival angle deviation of filling yarn and a pressure correcting section for outputting a pressure correction amount of an injection pressure in a locking nozzle on the basis of a flying term deviation of filling yarn. The angle correcting section promptly corrects and controls a change of an arrival angle caused by a variation of flying characteristic of filling yarn, and thereafter the pressure correcting section corrects and controls a flying term so as to be adjusted to a set value. As a result, a stable picking operation in which only the picking start angle is not excessively deviated can be accomplished.

6 Claims, 5 Drawing Sheets

PICKING CONTROL FOR AIR JET LOOM WITH TIMING AND PRESSURE CORRECTION

BACKGROUND ART

This invention relates to a picking control apparatus for looms in which even when the flying characteristic of filling yarns is varied in a jet room, stable picking operation can be continued.

In a jet room, particularly in an air jet room, picking sometime becomes unstable due to a change in flying characteristic of filling yarns used for weaving. This unstable phenomenon is considered to result mainly from the fact that yarn properties such as coarseness of yarns, sizes of fuzz and the like vary in a longitudinal direction whereby air resistance of yarns changes.

In view of the foregoing, various procedures have been proposed in order to continue a stable picking operation even when the flying characteristic of filling yarns is varied. According to the most representative procedure, a loom mechanical angle, (hereinafter referred to as a weft arrival angle) in which a filling yarn having a predetermined length arrives at the opposite side of picking of woven cloth is monitored. A variation in flying characteristic of filling yarns is grasped by the change of the arrival angle, and a loom mechanical angle (hereinafter referred to as a start angle) at which picking operation starts accordingly as well as injection pressures of a main nozzle and a sub-nozzle for picking are controlled.

The aforementioned control is accomplished in a manner such that, for example, when a delay of the arrival angle is detected because the flying characteristic of filling yarns lowers, the start angle is quickened and injection pressure is increased in order to correct such a delay. On the other hand, with respect to the lead of the arrival angle, both the start angle and injection pressure are controlled reversely of the former to thereby maintain a constant arrival angle, which obtains a better result than the case where only one of the start angle and the injection pressure is controlled. That is, in the case where only the start angle is corrected, time balance with weft shedding becomes broken, and as a result, defective picking such as so-called warp engagement, blow-off of filling yarns and the like is liable to occur. On the other hand, in the case where only the injection pressure is corrected, there was a problem in that it cannot precisely follow the variation of the flying characteristic of filling yarns due to the slow response thereof.

However, even when both the start angle and the injection pressure are controlled, problems remain as follows. That is, since correction information based on the advance or delay of the arrival angle is merely transmitted simply parallel to control systems for controlling the start angle and the injection pressure, and therefore, it is difficult to continue stable picking operation in a real machine for the reason mentioned below.

Generally, the responsiveness of the picking member to the change of the start angle is high but the time responsiveness to the change of the injection pressure is limited. Accordingly, when the advance or delay arrival angle occurs, information of which is applied in parallel to both the control systems, the correction of the start angle, which is excellent in responsiveness, is first effected, and the correction of the injection pressure is then effected. Therefore, if the arrival angle is returned to its normal state by the correction of the start angle, the later correction of the injection pressure need not be conducted. In other words, the correction of the injection pressure is effected only in the case where even if the start angle is corrected to a correction limit determined in terms of the warp shedding, the advance or delay of the arrival angle still remains. Yet, even if the advance or delay of the arrival angle is overcome by the correction of the injection pressure, the start/angle is not pulled back from the correction limit.

For the reason described above, there was an inconvenience in that the later operation of the loom is carried out in the state where the start angle is at a correction limit, making it extremely difficult to realize continuation of a stable picking operation.

OBJECTS OF THE INVENTION

It is a principal object of the present invention to provide a picking control apparatus in looms in which both control of a start angle and control of an injection pressure are effected, and even if the control of the start angle is temporarily greatly deviated, it is again returned to a normal value and the control of the start angle and the control of the injection pressure are prevented from being carried out in a one-sided manner so as not to lose the time balance with the warp shedding, thus continuously realizing the stable picking operation.

It is a further object of the invention to eliminate useless operation as much as possible in the control device for the injection pressure.

SUMMARY OF THE INVENTION

According to the present invention, when the flying characteristic of filling yarns is varied and as a result, the advance or delay occurs in its arrival angle, the correction operation of the start angle is carried out by an angle correcting section and a timing controller in accordance with a deviation in arrival angle.

On the other hand, when the flying characteristic of filling yarns varies, a flying term, which represents a loom mechanical turn angle from a weft starting angle to a weft arrival angle at the opposite side of picking, varies to produce a deviation of the flying term. A pressure correction amount based thereon is delivered to a pressure controller whereby correction of the injection pressure is effected in the pressure correcting section. At this time, the pressure controller corrects the injection pressure independently of the timing controller so as to realize the injection pressure suited to the flying characteristic of filling yarns in accordance with the deviation of the flying term. Therefore, finally, the injection pressure is corrected in correspondence to a varied portion of the flying characteristic.

As the injection pressure is corrected as described above and the flying term of filling yarns returns to a normal set flying term, the angle correcting section is operative to return the start angle to the normal set start angle. Accordingly, the injection pressure is to be corrected in accordance with a variation in the flying characteristic of filling yarns, and the stable picking operation according to the normal set start angle and the set arrival angle can be continued.

If a limiter element is interposed between the angle correcting section and the timing controller, even when a large deviation of the arrival angle occurs, a command start angle is prevented from being excessively deviated and the time balance with the warp shedding is not possibly lost.

Moreover, if a dead band element is interposed between the pressure correcting section and the pressure controller, a response of the pressure controller to a fine pressure correction amount can be eliminated to minimize unnecessary damage to mechanical parts such as a pressure regulating valve.

Furthermore, as a flying term of filling yarns, if a difference in angle between the arrival angle and the command start angle is taken, it is possible to easily maintain the relative relation with the warp shedding operation in a predetermined state.

DETAILED DESCRIPTION OF THE INVENTION

An embodiment will be described hereinafter with reference to the drawings.

Figure 1:
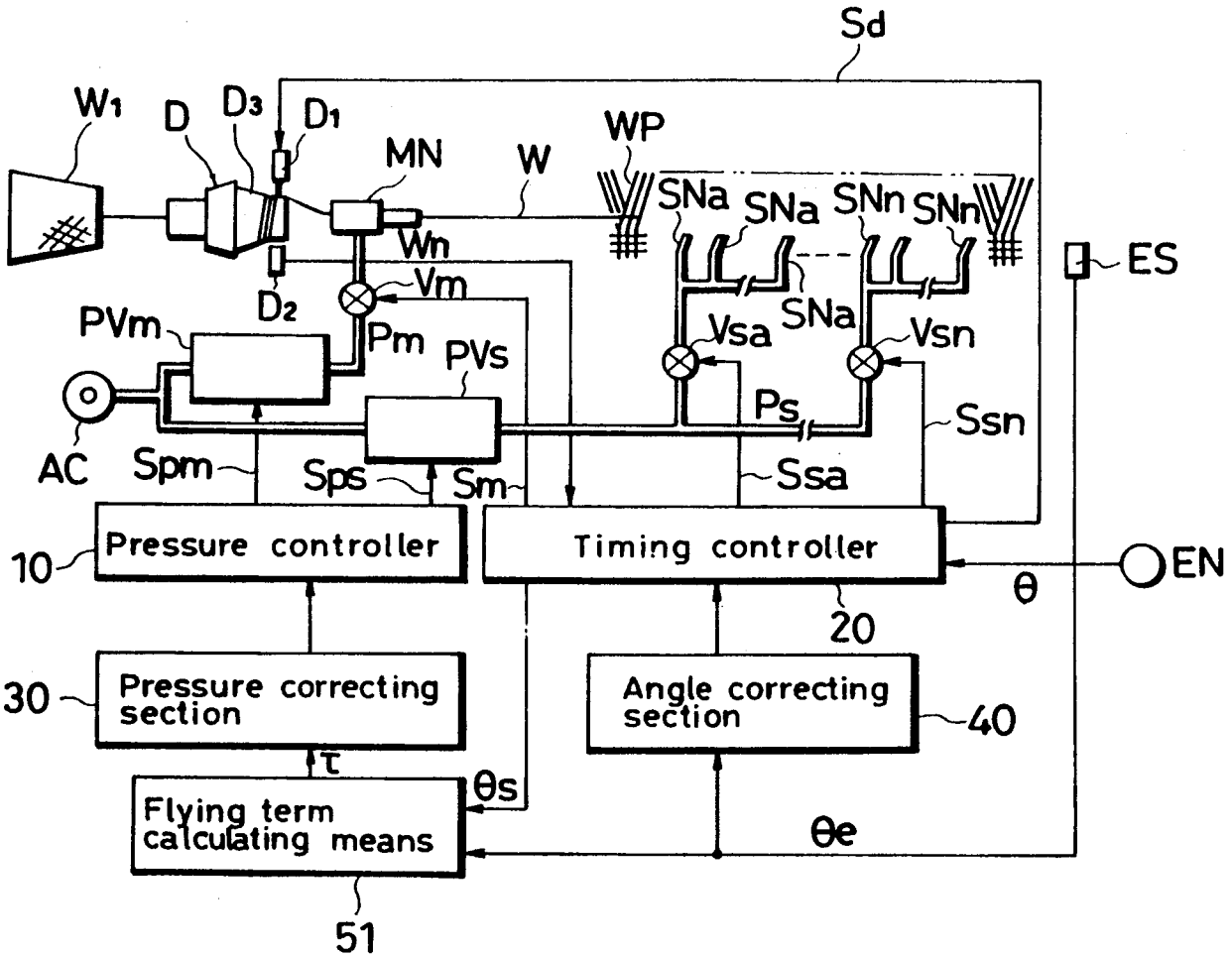
FIG. 1 is a general view of the structure of a loom and picking control apparatus according to a first embodiment of the invention.

The loom comprises an air jet room as shown in FIG. 1. A filling yarn W released from a yarn feeder $W_1$ is laid into a drum type weft length-measuring retention device (hereinafter merely referred to as a retension device) D and into a warp shedding WP via a main nozzle MN. Sub-nozzles SNi, SNi . . . (i=a, b . . . n) divided into plural groups are disposed along the travel path of the filling yarn W.

The retention device D is provided with an engaging pin $D_1$ and a release sensor $D_2$. The filling yarn W wound about and retained on a drum $D_3$ is laid by driving the engaging pin $D_1$ to a release position by picking signals Sd, Sm, Ssi (i=a, b . . . n) from a timing controller 20, opening valves Vm, Vsi (i=a, b . . . n) and operating a main nozzle, sub-nozzles SNi, SNi . . . and an insertion length Wn is measured by the release sensor $D_2$.

The main nozzle MN and the sub-nozzles SNi, SNi . . . are connected to a common air source AC through the valves Vm and Vsi and pressure regulating valves PVm and PVs, and injection pressures Pm and Ps thereof are controlled by control signals Spm and Sps from the pressure controller 10. On the opposite side of picking of woven cloth is disposed an arrival angle sensor ES for detecting an arrival angle $\theta e$ of the laid filling yarn W, and a loom mechanical angle $\theta$ from an encoder EN is inputted into the timing controller 20.

Figure 2:
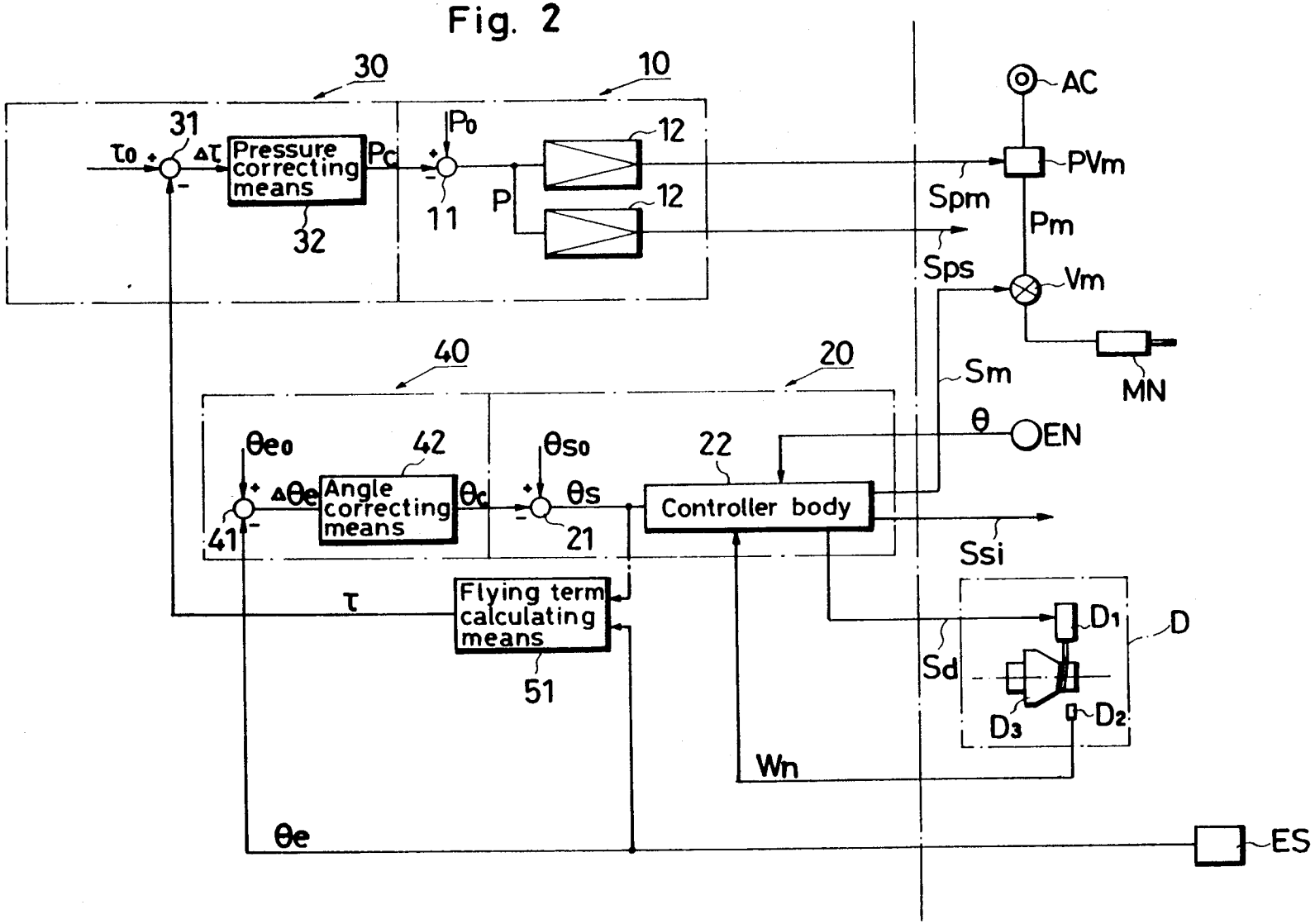
FIG. 2 is a systematic view of the picking control apparatus according to the embodiment illustrated in FIG. 1.
Figure 3:
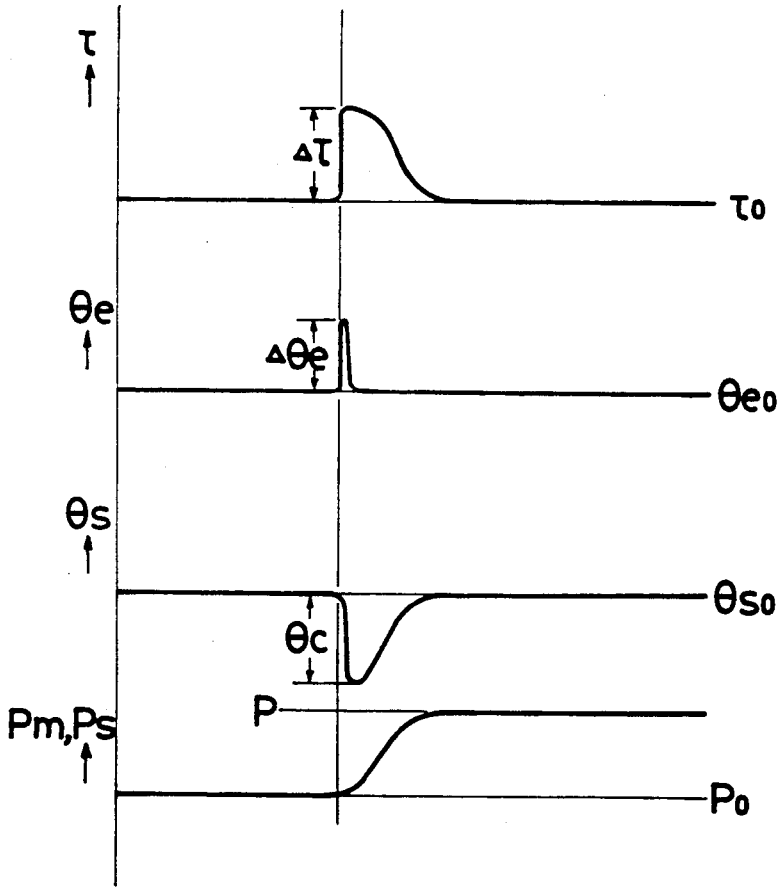
FIG. 3 is a working diagram of the picking control apparatus.

The picking control apparatus in comprises principal members comprising a pressure controller 10, a timing controller 20, a pressure correcting section 30 and an angle correcting section 40, as shown in FIG. 2.

In the pressure controller 10, at an add point 11 a set injection pressure Po from an injection pressure setter (not shown) and a pressure correction amount Pc from the pressure correcting section 30 are inputted. The output of add point 11 is connected to two control amplifiers 12 and 12, and outputs thereof as control signals Spm and Sps are inputted into the pressure regulating valves PVm and PVs. The set injection pressure Po and pressure correction amount Pc are inputted into an addition terminal and a subtraction terminal, respectively, of the add point 11. A control system on the loom side with respect to the sub-nozzles SNi, SNi . . . is not shown.

In the timing controller 20, the add point 21 is connected to the controller body 22. A set start angle $\theta so$ from a start angle setter not shown and an angle correction amount $\theta c$ from the angle correcting section 40 are inputted into the addition terminal and the subtraction terminal, respectively, of the add point 21. The controller body 22 compares a command start angle $\theta s=\theta so-\theta c$ from the add point 21 with a loom mechanical angle $\theta$ from the encoder EN to output picking signals Sd, Sm and Ssi. At $\theta=\theta s$, picking is started. When a laid length Wn from the release sensor $D_2$ assumes a predetermined value, picking is completed. That is, the timing controller 20 controls operating time of a picking member composed of the engaging pin $D_1$, the main nozzle MN and the sub-nozzles SNi, SNi . . .

The pressure correcting section 30 and the angle correcting section 40 are located before the pressure controller 10 and the timing controller 20, respectively.

The pressure correcting section 30 comprises an add point 31 and a pressure correcting means 32. A set flying term $\tau_o$ from a flying term setter not shown is inputted into the addition terminal of the add point 31. A flying term $\tau$ of the filling yarn W from a flying term calculation means 51 is inputted into the subtraction terminal. The pressure correcting means 32 includes a PID control element, and inputs a flying term deviation $\Delta\tau=\tau_o-\tau$ from the add point 31 to calculate a pressure correction amount Pc to output it to the pressure controller 10. The flying term calculating means 51 inputs a command start angle $\theta s=\theta so-\theta c$ from the timing controller 20 and an arrival angle $\theta e$ from the arrival angle sensor ES to calculate a flying term $\tau=\theta e-\theta s$ of the filling yarn W with a loom mechanical angle $\theta$ as a unit to output the same.

The angle correcting section 40 comprises an add point 41 and an angle correcting means 42. The add point 41 inputs a set arrival angle $\theta eo$ from an arrival angle setter not shown and an arrival angle $\theta e$ of the filling yarn W to output an arrival angle deviation $\Delta\theta e=\theta eo-\theta e$ whereas the angle correcting means 42 inputs an arrival angle deviation $\Delta\theta e$ to output an angle correcting amount $\theta c$ to the timing controller 20 via suitable PID calculation.

For example, when normal picking operation is executed, the filling yarn W starts to be laid at a set start angle $\theta so$ by the timing controller 20 and arrives at the side opposite to picking at the set arrival angle $\theta eo$. That is, since at this time, the arrival angle is $\theta e=\theta eo$, the arrival angle deviation is $\Delta\theta e=\theta eo-\theta e=0$, and the angle correction amount $\theta c$ from the angle correcting section 40 is $\theta c=0$.

The flying term $\tau$ of the filling yarn W is $\tau=\tau_o$, and the pressure correction amount Pc from the pressure correcting section 30 is Pc=0. The injection pressure Pm and Ps from the main nozzle MN, sub-nozzles SNi, SNi . . . realized by the pressure controller 10 and pressure regulating valves PVm, PVs also coincide with the set injection pressure.

When the flying characteristic of the filling yarn W is lowered for some cause, the flying term $\tau$ of the filling yarn W is $\tau > \tau_o$, and the arrival angle $\theta e$ is $\theta e > \theta eo$ behind the set arrival angle $\theta eo$. Accordingly, the add point 41 of the angle correcting section 40 detects the arrival angle deviation $\Delta\theta e = \theta eo - \theta e < 0$ to output it to the angle correcting means 42. The angle correcting means 42 calculates the angle correction amount $\theta c$ using $\theta c = f(\Delta\theta e) > 0$ (wherein f represents a control function including a part or whole of PID element) to output it to the timing controller 20. Therefore, the timing controller 20 uses thus obtained angle correction amount $\theta c$ to start picking at the command start angle $\theta s = \theta so - \theta c < \theta so$ to thereby promptly remove the arrival angle deviation $\Delta\theta e$.

On the other hand, the flying term calculating means 51 detects the flying term by subtracting command start angle $\theta s$ from arrival angle $\theta e$ and outputs it to the pressure correcting section 30, and therefore the add point 31 of the pressure correcting section 30 outputs the flying term deviation $\Delta\tau = \tau_o - \tau < 0$ to the pressure correcting means 32. The pressure correcting means 32 calculates the pressure correction amount Pc with $Pc = g(\Delta\tau) < 0$ (wherein g represents a control function including a part or whole of PID element) to output it to the pressure controller 10, and therefore the pressure controller 10 corrects the set injection pressure Po in a direction in which the flying term deviation $\Delta\tau$ is erased to output the result as the command injection pressure P to the pressure regulating valves PVm and PVs through the control amplifiers 12 and 12. That is, when the flying term deviation is $\Delta\tau < 0$, the direction of correction is selected so as to have $P > Po$ in correspondence thereto. As the result, the injection pressure Pm and Ps from the main nozzle MN and sub-nozzles SNi, SNi . . . are corrected to $Pm = Ps = P > Po$ by the pressure regulating valves PVm and PVs.

The injection pressures Pm and Ps are corrected as described above whereby the flying term $\tau$ can be corrected to the set flying term $\tau_o$.

Ordinarily, the responsiveness of the pressure controller including the pressure regulating valves PVm and PVs is much slower than that of the timing controller 20. Therefore, the flying term $\tau$ is corrected whereby the angle correcting section 40 functions to return the command start angle $\theta s$ to the set start angle $\theta so$ in order to maintain the arrival angle $\theta e$ at the set arrival angle $\theta eo$. That is, the command start angle $\theta s$ can be returned to the set start angle $\theta so$ so as to follow the correction of the injection pressures Pm and Ps by the pressure controller 10. Finally, the injection pressures Pm and Ps are positively corrected to $Pm = Ps = P$, and the command start angle $\theta s$ can be returned to $\theta s = \theta so$ in correspondence thereto.

The whole operation carried out when the flying characteristic of the filling yarn W becomes high so that the arrival angle $\theta e$ is deviated in the direction of $\theta e < \theta eo$ and the flying term $\tau$ is $\tau < \tau_o$ is reversed to that of the above description. The injection pressure Pm and Ps achieved are $Pm = Ps = P < Po$, and the command start angle $\theta s$ is returned to $\theta s = \theta so$.

ANOTHER EMBODIMENT

Figure 4:
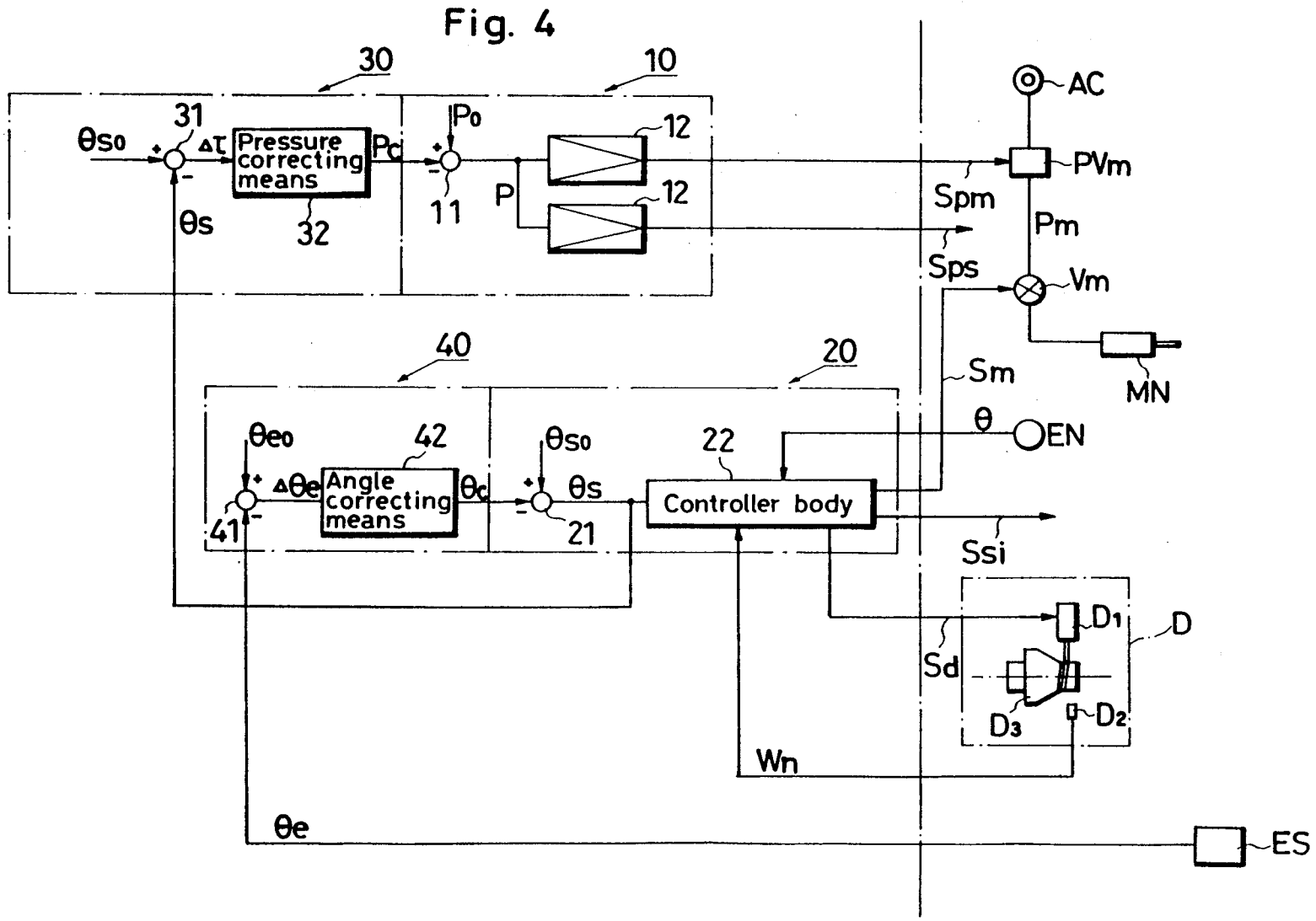
FIG. 4 is a systematic view of a picking control apparatus according to a second embodiment of the invention.

FIG. 4 shows another embodiment of the present invention, in which the flying term deviation $\Delta\tau$ is obtained from the set start angle $\theta so$ and the command start angle $\theta s$. That is, the set arrival angle $\theta so$ from the arrival angle setter and the command start angle $\theta s$ in the timing controller 20 are inputted into the added point 31 of the pressure correcting section 30, and the command start angle $\theta s$ is subtracted from the set start angle $\theta so$ whereby the flying term deviation $\Delta\tau$ is calculated and the pressure correction amount is calculated in the pressure correcting means 32 so as to control the injection pressures Pm and Ps similarly to the embodiment shown in FIG. 2.

Figure 5:
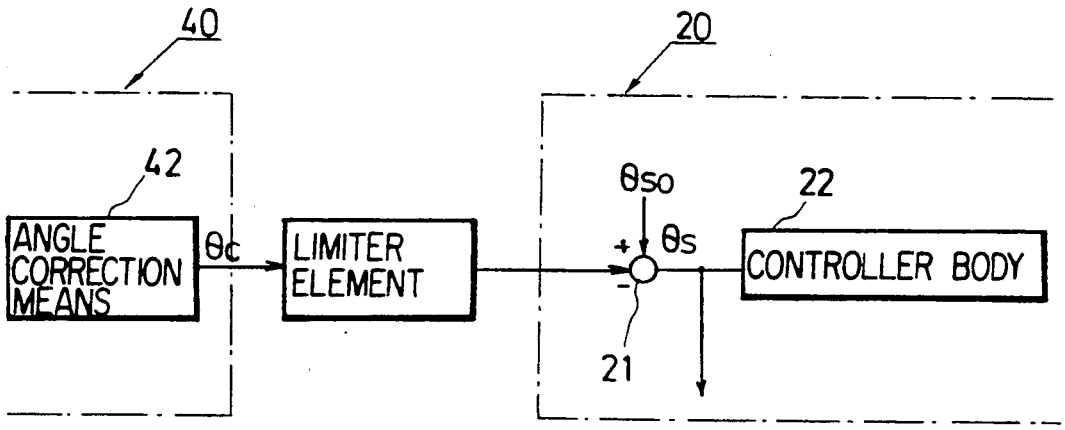
FIG. 5 illustrates an embodiment of the picking control apparatus wherein a limiter element is inserted between the angle correction section and the timing controller.

Preferably, a limiter element is interposed between the angle correcting section 40 and the timing controller 20 as shown in FIG. 5. Thereby, even if the arrival angle deviation $\Delta\theta e$ is excessively large, it is possible to eliminate possibility that the command start angle $\theta s$ is excessively deviated and the time balance with the warp shedding becomes lost.

Figure 6:
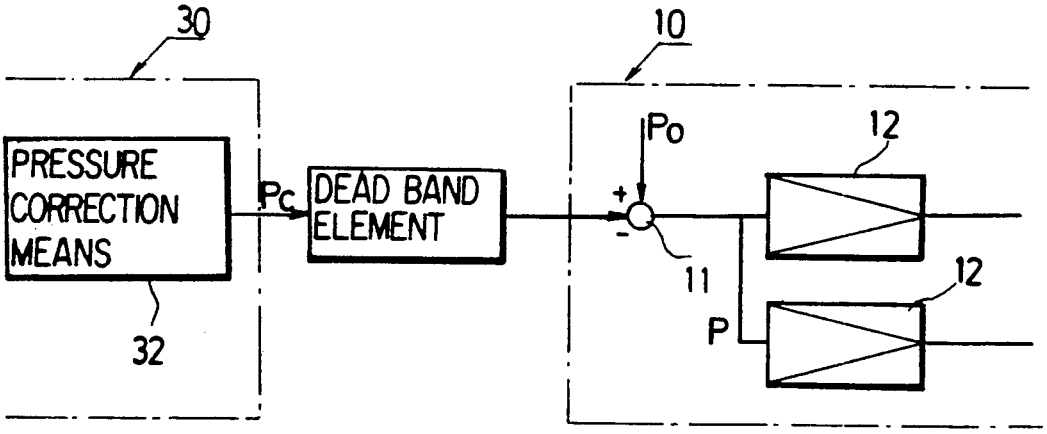
FIG. 6 illustrates an embodiment of the picking control apparatus wherein a dead band element is interposed between the pressure correcting section and pressure controller.

Alternatively, a dead band element may be interposed between the pressure correcting section 30 and the pressure controller 10, as shown in FIG. 6. Thereby, the dead band element can function not to deliver a fine pressure correction amount Pc within the dead band width to the pressure controller 10 to minimize a chance for unnecessary fine operation in the pressure controller 10 and the pressure regulating valves PVm and PVs as accessories thereof.

While in the above description, the injection pressures Pm and Ps of the main nozzle MN and sub-nozzles SNi, SNi . . . were always in the relationship of $Pm = Ps = P$, it is to be noted that a suitable ratio setting element is interposed on input sides of the control amplifiers 12 and 12 so that the injection pressures Pm and Ps are made to be different from each other with $Pm = aPs$ (wherein a is constant which is not 1). The pressure regulating valves PVs may be disposed every group of sub-nozzles SNi, SNi . . . so as to realize different injection pressures every group. That is, injection pressures of each picking nozzle composed of the main nozzle MN and sub-nozzles SNi, SNi . . . may be made to be collective as a whole or may be used for one controlled by the pressure controller 10 by dividing the main nozzle MN alone or sub-nozzles SNi, SNi . . . into suitable groups.

The whole control system of FIG. 2 including the pressure correcting section 30 and the angle correcting section 40 can be realized by either analog system or digital system. Particularly in case of the latter, the apparatus can be operated in correspondence to the picking operation of the loom. In the latter, the flying term deviation $\Delta\tau$, and the arrival angle deviation $\Delta\theta e$ may be calculated every picking in accordance with moving average values of the flying terms $\tau$, $\tau$ . . . and arrival angles $\theta e$, $\theta e$ . . . in plural times of picking operations or may be calculated every given picking number in accordance with the average value of the given picking number.

While the set flying term $\tau_o$ and the flying term $\tau$ have been used as parameters of angles, it is to be noted that they may be used as parameters of time. In the flying term calculating means 51, a difference in time from the command start angle $\theta s$ to the arrival angle $\theta e$ is measured and the set flying term $\tau_o$ is set to a value corresponding to time required for normal flying of the filling yarn W.

The timing controller 20 is designed to start the operation of a picking member composed of a main nozzle MN, sub-nozzles SNi, SNi . . . and an engaging pin $D_1$ when the loom mechanical angle $\theta$ coincides with the command start angle $\theta s$. However, a suitable difference in time may be provided for an operating term of the picking member, if necessary. That is, operation of the main nozzle MN may be started prior to operation of the engaging pin $D_1$ by a predetermined time or vice versa.

Furthermore, if a signal is generated when the yarn feeder is switched and an angle correction amount stored in advance is outputted to the timing controller 20 by said signal, forward control can be made to thereby stabilize picking when the feeder is switched.

As described above, according to the present invention, the pressure correcting section and the angle correcting section are combined with the pressure controller and the timing controller, respectively, when the advance or delay of the arrival angle on the basis of the variation of the flying characteristic of the filling yarn at the time of picking occurs, this can be quickly corrected by changing the start angle. On the other hand, the injection pressure of the picking nozzle having no quick responsiveness is to be corrected on the basis of the flying term deviation produced at that time, and the start angle is finally returned to the normal set start angle. Accordingly, there are effects that operation in the unstable state where only the start angle is excessively deviated can be eliminated and the stable picking operation can be continuously realized.

What is claimed is:

1. A picking control apparatus in looms comprising: a pressure controller for controlling injection pressure of a picking nozzle, a timing controller for controlling operating time of a picking member, a pressure correcting section attached to said pressure controller, and an angle correcting section attached to said timing controller, wherein said angle correcting section includes means for calculating an arrival angle deviation from an arrival angle of filling yarn and a set arrival angle to output an angle correction amount on the basis of said arrival angle deviation to said timing controller, and said pressure correcting section includes means for calculating a flying term deviation of filling yarn to output a pressure correction amount on the basis of said flying term deviation to said pressure controller.

2. A picking control apparatus in looms according to claim 1, wherein said flying term deviation is calculated by means for determining a difference between a flying term of filling yarn and a set flying term.

3. A picking control apparatus in looms according to claim 1, wherein said flying term deviation is calculated by means for determining a difference between a set start angle and a command start angle from said timing controller.

4. A picking control apparatus in looms according to claim 1, wherein a limiter element is interposed between said angle correcting section and said timing controller.

5. A picking control apparatus in looms according to claim 1, wherein a dead band element is interposed between said pressure correcting section and said pressure controller.

6. A picking control apparatus in looms according to claim 2, wherein said flying term of filling yarn is calculated by means for determining an angle difference between an arrival angle of filling yarn and a command start angle from said timing controller.

* * * * *